US010141690B2

(12) United States Patent
Bozikis

(10) Patent No.: US 10,141,690 B2
(45) Date of Patent: Nov. 27, 2018

(54) ELECTRICAL PLUG AND SOCKET SECUREMENT SYSTEM

(71) Applicant: Vaios Nikolaos Bozikis, Moraga, CA (US)

(72) Inventor: Vaios Nikolaos Bozikis, Moraga, CA (US)

( * ) Notice: Subject to any disclaimer, the term of this patent is extended or adjusted under 35 U.S.C. 154(b) by 0 days.

(21) Appl. No.: 15/441,228

(22) Filed: Feb. 23, 2017

(65) Prior Publication Data

US 2017/0170603 A1 Jun. 15, 2017

Related U.S. Application Data

(63) Continuation-in-part of application No. 14/450,303, filed on Aug. 4, 2014, now Pat. No. 9,583,878.

(51) Int. Cl.
*H01R 13/639* (2006.01)
*H01R 43/26* (2006.01)

(52) U.S. Cl.
CPC ..... *H01R 13/6392* (2013.01); *H01R 43/26* (2013.01)

(58) Field of Classification Search
CPC ..... H01R 13/6392; H01R 13/639; H01R 13/6271; H01R 13/6272; H01R 13/6273; H01R 43/26
USPC ..... 439/369, 345, 296, 144
See application file for complete search history.

(56) References Cited

U.S. PATENT DOCUMENTS

| | | | | |
|---|---|---|---|---|
| 3,014,194 | A | 12/1961 | Na | |
| 3,609,638 | A * | 9/1971 | Darrey | H01R 13/6392 24/332 |
| 3,985,415 | A | 10/1976 | Wolpert | |
| 4,085,991 | A | 4/1978 | Marshal | |
| 4,143,934 | A | 3/1979 | Siebert | |
| 4,643,505 | A | 2/1987 | House et al. | |
| 4,925,396 | A | 5/1990 | Grover | |
| 4,954,097 | A | 9/1990 | Sekiguchi | |
| 5,129,839 | A | 7/1992 | VanSkiver | |
| 5,135,409 | A | 8/1992 | Thompson | |
| 5,154,626 | A | 10/1992 | Watson | |
| 5,393,243 | A | 2/1995 | Carmo | |
| 5,507,664 | A | 4/1996 | Carmo | |
| 5,573,420 | A | 11/1996 | Grosswendt | |
| 5,820,398 | A | 10/1998 | Stabroth et al. | |
| 5,830,000 | A | 11/1998 | shifflett et al. | |
| 6,056,557 | A | 5/2000 | Crotzer et al. | |
| 6,080,004 | A | 6/2000 | Kovacik et al. | |
| 7,182,624 | B1 * | 2/2007 | Miller | H01R 13/6392 439/369 |
| 7,347,708 | B1 | 3/2008 | Huang | |
| 8,215,977 | B2 | 7/2012 | Zapf | |
| 8,287,292 | B2 | 10/2012 | Byrne | |

* cited by examiner

*Primary Examiner* — Vanessa Girardi
(74) *Attorney, Agent, or Firm* — S. Elizabeth Miller, Esq.

(57) ABSTRACT

An electrical plug fastener or retention mechanism comprising a system of binding or securing electrical plugs or other connectors to avoid unintentional or accidental disconnection. The retention mechanism comprises a means for connecting to a first cord and a second cord. The retention mechanism is hinged and comprises a clamp. The clamp further comprises a clip that can also engages the first or second cord.

15 Claims, 9 Drawing Sheets

ELECTRICAL PLUG AND SOCKET SECUREMENT SYSTEM

This application is a continuation-in-part of U.S. patent application Ser. No. 14/450,303, filed on Aug. 4, 2014, the disclosure of which is incorporated in its entirety by reference herein.

FIELD OF INVENTION

The field of invention is electrical devices, plugs, retention mechanisms, securement systems, clamps, locks or fasteners, more specifically electrical devices or electrical plugs that prevent unintentional disconnection with a clamp, lock or fastener.

BACKGROUND OF THE INVENTION

The present invention relates to a device, fastener, lock, retention mechanism, or clamp for preventing electrical plugs from becoming unintentionally disconnected. Electrical plugs often become unintentionally disconnected when powering mobile equipment, including but not limited to, power tools and outdoor lawn maintenance equipment.

SUMMARY OF INVENTION

A purpose of the devices and securement systems described herein is to prevent unintentional separation of two connectors, each of which is attached to a cord. The devices also allow a secure connection between connectors, which remain connected even under significant amounts of force. The devices and securement systems described herein fasten the two connectors together so that accidental disconnection does not occur.

Another purpose of the devices and securement systems described herein is primarily to prevent unintentional separation of disconnectable electrical plugs that connect to electrically powered devices or power cords. The devices and securement systems described herein fasten electrical plugs together so that accidental disconnection does not occur. Each device is designed to secure the electrical plugs together in a manner such that they will remain connected until intentionally disconnected. The devices also allow a secure connection between electrical plugs, which remain connected even under significant amounts of force. The devices may be easily engaged or disengaged, yet when engaged, the connection is secure.

Another advantage of the devices and securement systems and described herein is that the systems can be used with connectors and plugs of varying shapes and sizes, so that specially designed plugs are unnecessary for the device to operate. Thus, the securement systems and devices described herein can be used to facilitate and maintain connections between any standard plugs or connectors, and many non-standard plugs or connectors.

Securement system is sometimes referred to herein as a system of securing a connector, or simply a device.

A first side, comprises a base. The base may be any type of hollow base that allows a cord to run through an opening in the middle. Herein, a base may be called a tubular base, a screw base, or a twisting base, as described in further detail herein. The first side can be used interchangeably with any base.

In one embodiment, the device may be a mechanism having a first side and a second side. The first side comprises a metal or plastic base, which acts as a retention mechanism.

A first cord runs through the base and is permanently or removably affixed to the base. The base further comprises two openings that hold pins with stoppers on opposing side of the base, creating a first hinge, hinge receptacle, or hinged unit and a second hinge, hinge receptacle, or hinged unit. The outer portion of each hinge, hinge receptacle, or hinged unit is connected to a bar. The bar may be made of any metal, metal alloy or plastic, and is optionally coated in rubber, a non-conductive material, a material known to have grip, or another suitable material. Each bar extends out and around a first connector that is secured to a second connector, once clear of secured connectors the bar defines, and connect to, the second side. The second side comprises a clamp having a movable half and a fixed half. The bars connect to fixed half of the clamp. The fixed half connected to moveable half with a second hinge. The second hinge comprises a hub, which may be comprised of a rounded bar and is attached to one end of the fixed half of the clamp, and an elliptical piece is attached to the moveable half of the clamp, or the moveable half having an elliptical shape at one end that is uniquely suited to engage the hub. The hub engages the elliptical piece, or the one end of moveable half, to create an increased point of friction right before clamp is fully engaged as to fix the clamp in a locked position. The hub and elliptical piece, or the one end of moveable half, are made from polished stainless steel or a similar material as to not corrode, and to slide past each other at heightened point of friction. The hinge also optionally further comprise teeth and a pin, that facilitate engagement. The fixed half and moveable half each have a rubber center, which increases friction between clamp and the second cord and thus, enables a tight connection to the first cord without damaging it. The moveable half of the clamp optionally comprises a lever or grip, which makes it easier for the clamp to be manually opened or closed, and manually engaged or disengaged with the second cord. The clamp also optionally comprises a clip. When disengaged, the clamp may be secured to the second cord as the base via a clip which is preferably attached to the fixed half of the clamp (so as to not get in the way and flap around when clamp in knot needed). The clip may also be used to hold the second cord, or another cord.

In another embodiment, the device may be a mechanism having a first side and a second side. The first side comprises a metal or plastic base, which acts as a retention mechanism. A first cord runs through the base and is permanently or removably affixed to the base. The base further comprises one or more openings that hold pins with stoppers on the side of the base, creating one or more first hinges, hinge receptacles, or hinged units. The outer portion of the one or more first hinges, hinge receptacles, or hinged units is connected to one or more bars. The one or more bars may be made of any metal, metal alloy or plastic, and are optionally coated in rubber, a non-conductive material, a material known to have grip, or another suitable material. The one or more bars extend out and around a first connector that is secured to a second connector, once clear of secured connectors the one or more bars define, and connect to, the second side. The second side comprises a clamp having a movable half and a fixed half. The one or more bars connect to fixed half of the clamp. The fixed half connected to moveable half with a second hinge. The second hinge comprises a hub, which may be comprised of a rounded bar and is attached to one end of the fixed half of the clamp, and an elliptical piece is attached to the moveable half of the clamp, or the moveable half having an elliptical shape at one end that is uniquely suited to engage the hub. The hub engages the elliptical piece, or the one end of moveable half, to create an increased point of friction right before clamp is fully engaged as to fix the clamp in a locked position. The hub and elliptical piece, or the one end of moveable half, are made from polished stainless steel or a similar material as to not corrode, and to slide past each other at heightened point of friction. The hinge also optionally further comprise teeth and a pin, that facilitate engagement. The fixed half and moveable half each have a rubber center, which increases friction between clamp and the second cord and thus, enables a tight connection to the first cord without damaging it. The moveable half of the clamp optionally comprises a lever or grip, which makes it easier for the clamp to be manually opened or closed, and manually engaged or disengaged with the second cord. The clamp also optionally comprises a clip. When disengaged, the clamp may be secured to the second cord as the base via a clip which is preferably attached to the fixed half of the clamp (so as to not get in the way and flap around when clamp in knot needed). The clip may also be used to hold the second cord, or another cord.

One embodiment is a devices device securing engaged connectors, comprising; a first side comprising a base with a first opening engaging a first cord attached to a first connector; a second side including a retention mechanism comprising a fixed half including a movable half, the two halves connected at one edge, via a locking hinge, forming a clamp with a second opening engaging a second cord attached to a second connector; one or more bars, the one or more bars each movably attached at one end of the base, the one or more bars each having a distal portion and a distal end extending away from the base past the first connector, one or more distal ends each fixably attached to the fixed half; and wherein the first and second connectors are oriented within the bars enabling engagement of the connectors, and the retention mechanism prohibits separation of the connectors, once closed and locked.

Any embodiment of a device described herein may also comprise a base, wherein the base includes one or more tracks positioned at outer side of the base, each one or more tracks accepting a hinge receptacle attaching a proximal end of the bar, the one or more hinge receptacles freely translating along the one or more tracks and the one or more proximal ends of the bars freely rotate in the hinge receptacles.

Any embodiment of a device described herein may also comprise one or more bars, wherein the proximal ends of each one or more bars attaches to one or more hinged receptacles at a perpendicular angle and the distal portions of the one or more bars include at least two obtuse angles at a same position on each distal portion of the one or more bars, thereby creating a greater distance between the distal portions of the one or bars than a first distance between the one or more distal ends attached to the fixed half and a second distance between the hinge receptacles.

Any embodiment described herein, wherein the one or more bars attached at the base translate back and forth in one or more tracks when the clamp is in an open position enabling flexibility of movement between the connectors when engaging the first and second connectors.

Any embodiment of a device herein comprising at least one track, wherein at least one row of ratchet teeth are arranged in at the least one of track and a corresponding at least one pawl at proximal end of at least on bar in place of the at least one hinged receptacle, wherein when the at least one bar is oriented in a linear fashion extending past the first connector, the at least one pawl engages between two of the ratchet teeth, thereby prohibiting movement of the proximal end of the at least one bar along the track, and when the at least one bar is oriented perpendicular and below the tubular base, the pawl disengages from between the teeth enabling translation along the track.

One embodiment is a devices device securing engaged connectors, comprising; a first side comprising a base with a first opening engaging a first cord attached to a first connector; a second side including a retention mechanism comprising a fixed half including a movable half, the two halves connected at one edge, via a locking hinge, forming a clamp with a second opening engaging a second cord attached to a second connector; two bars, one each movably attached at a proximal end to opposing sides of the base, the bars each having a distal portion and a distal end extending away from the base past the first connector, one each of the distal ends fixably attached at opposing sides of the fixed half; and wherein the first and second connectors are oriented within the elongated bars enabling engagement of the connectors, and the retention mechanism prohibits separation of the connectors, once closed and locked.

Any embodiment described herein comprising a base and two bars, may further comprise a base wherein the includes two tracks positioned at opposing outer sides of the base, each track accepting a hinge receptacle attaching the proximal end of the bars, the hinge receptacles freely translating along the tracks and the proximal ends of the bars freely rotate in the hinge receptacles Any embodiment described herein comprising two bars, wherein the proximal ends of the bars attach to the hinged receptacles at a perpendicular angle and the distal portions of the bars include at least two obtuse angles at a same position on each distal portion of the bars, thereby creating a greater distance between the distal portions of the two bars than a first distance between the distal ends attached to the fixed half and a second distance between the hinge receptacles.

Any embodiment described herein, wherein the bars attached at the base translate back and forth in the tracks when the clamp is in an open position enabling flexibility of movement between the connectors when engaging the first and second connectors.

Any method described herein that requires device having one or more tracks, which may be recessed, an integral part of, or mounted onto the base, positioned at a side of the base, each track accepting a hinge receptacle attaching a proximal end of the one or more bars, the one more hinge receptacles freely translating along the one or more tracks and the one or more proximal ends of the bars freely rotate in the hinge receptacles.

Any method described herein, wherein the proximal ends of one or more bars attaches to the one or more hinged receptacles at perpendicular, or substantially perpendicular, angles and the distal portions of the one or more bars include at least one obtuse angle at a same position on each distal portion of the one or more bars thereby creating a greater distance between the distal portions of the one or more bars than a first distance between the distal ends attached to the fixed half and a second distance between the hinge receptacles.

A method for securing two engaged connector ends of two cords, comprising the steps of; a) engaging a first cord attached to a first male or female connector through a base; b) engaging a second cord attached to a second male or female connector through an opening formed in a clamp comprising a fixed half and a movable half, the two halves connected at one edge, via a hinge; c) connecting the base and the clamp via one or more bars, each bar having a proximal end connected to a side of the base, and one or more distal ends of the bars, each distal end is fixably attached to the fixed half and each bar having a distal portion between the proximal end and the distal end; d) orienting the first and second connectors enabling engagement with each other, once engaged with the movable half closed the hinge lock engages preventing separation of the first and second connectors.

Any embodiment of a device herein comprising tracks on the base, wherein a row of ratchet teeth are arranged in at least one of the tracks and a corresponding pawl at proximal end of each bar in place of the hinged receptacle, wherein when the bars are oriented in a linear fashion extending past the first plug, the pawl engages between two of the ratchet teeth, thereby prohibiting movement of the distal end of the bars along the track, and when the bars are oriented perpendicular and below the tubular base, the pawl disengages from between the teeth enabling translation along the track.

Any embodiment herein, wherein the hinge or locking hinge locks when the movable half is closed upon the fixed half and the movable half includes a pin release connected to the hinge or locking hinge enabling release of the hinge or locking hinge when opening of the clamp is desired.

Any embodiment herein, wherein the base is removed or attached to a cord by a split running along a top side of the base, the split including a first edge having a first tap or threaded hole, and a second edge having a second tap or threaded hole, the first and second holes oriented on the first and second edge creating a throughway for inserting a fastening screw or other fastener.

A method for securing two engaged connector ends of two cords, comprising the steps of; a) engaging a first cord attached to a first male or female connector through a base; b) engaging a second cord attached to a second male or female connector through an opening formed in a clamp comprising a fixed half and a movable half, the two halves connected at one edge, via a hinge; c) connecting the base and the clamp via two bars, each bar having a proximal end connected, one each to opposing sides of the base, a distal end of the bars, each distal end is fixably attached to opposing sides of the fixed half and each bar having a distal portion between the proximal end and the distal end; d) orienting the first and second connectors enabling engagement with each other, once engaged with the movable half closed the hinge lock engages preventing separation of the first and second connectors.

Any method of using a device described herein that requires device having two tracks, which may be recessed, an integral part of, or mounted onto the base, positioned at opposing outer sides of the base, each track accepting a hinge receptacle attaching a proximal end of the bars, the hinge receptacles freely translating along the tracks and the proximal ends of the bars freely rotate in the hinge receptacles.

Any method of using a device described herein, wherein distal ends of the bars attach to the hinged receptacles at perpendicular, or substantially perpendicular, angles and the distal portions of the bars include at least one obtuse angle at a same position on each distal portion of the bars thereby creating a greater distance between the distal portions of the two bars than a first distance between the distal ends attached to the fixed half and a second distance between the hinge receptacles.

Any method of using a device described herein with one or more tracks, wherein the bars attached at the base translate back and forth in the tracks when the clamp is in an open position, enabling flexibility when engaging the first and second connectors. This method may further include a hinge on the clamp, wherein the hinge locks when the movable half is closed upon the fixed half and the movable half includes a pin release when opening of the clamp is desired.

Any method of using a device described herein, wherein a row of ratchet teeth are arranged in at least one of the tracks and a corresponding pawl at distal end of each bar in place of the hinged receptacle, wherein when the bars are oriented in a linear fashion extending past the first connector, the pawl engages between two of the ratchet teeth thereby prohibiting movement of the distal bar ends along the track, and when the bars are oriented perpendicular and below the tubular base, the pawl disengages from between the teeth enabling translation along the track.

Any method of using a device described herein, wherein the base is removed or attached to the cord by a split running along a top side of the tubular base, the split including a first edge having a first tap or threaded hole, and a second edge having a second tap or threaded hole, the first and second holes oriented on the first and second edge creating a throughway for inserting a fastening screw or other fastener.

A device for securing engaged connectors, comprising: a first side including a retention mechanism comprising a fixed half and a movable half, the two halves connected at one edge, via a hinge, forming a clamp with a second opening engaging a second cord attached to a second connector; a second side including a second retention mechanism having similar components as the first side, comprising a second fixed half and a second movable half, the two halves connected at one edge, via a second hinge, forming a second clamp with a second opening engaging a second cord attached to a second connector; one or more bars, each attached at a proximal end a side of the fixed half, the bars each having a distal portion and a distal end extending away from the first half base past the first connector, each distal end is attached to a side of the second fixed half; wherein the first and second connectors are oriented within the bars enabling engagement of the connectors and the first and second retention mechanism prohibits separation of the connectors, when closed and locked.

A device for securing engaged connectors, comprising: a first side including a retention mechanism comprising a fixed half and a movable half, the two halves connected at one edge, via a hinge, forming a clamp with a second opening engaging a second cord attached to a second connector; a second side including a second retention mechanism having similar components as the first side, comprising a second fixed half and a second movable half, the two halves connected at one edge, via a second hinge, forming a second clamp with a second opening engaging a second cord attached to a second connector; two bars, each attached at a proximal end to opposing sides of the fixed half, the bars each having a distal portion and a distal end extending away from the first half base past the first connector, one each of the distal ends attached at opposing sides of the second fixed half; wherein the first and second connectors are oriented within the bars enabling engagement of the connectors and the first and second retention mechanism prohibits separation of the connectors, when closed and locked.

A connector or connecters may be mean any connector, including, but not limited to, plug, socket, jack, electrical plug, electrical connector, cable connecter, male plug, female plug, hermaphrodite connector, video connector, audio connector, pin header connecter, temporary connector, RCA connecter, mount, ethernet connector, electrical power connector, USB connector, power connector, DC connector, phone connector, hybrid connecter, adapter, clip, modular connector, or any other connector know in the art.

A cord or cords may mean any cord or cable, including, but not limited to, electrical cord, electrical wiring, power cord, electrical cable, ethernet cord, audio cable, video cable, extension cord, or any other cord or cable known in the art.

Any base described herein may be any shape that is able to secure or engage a cord, and includes, but is not limited to, being a tubular base, cuboidal base, cubical base, octagonal prism base, heptagonal prism base, hexagonal prism base, pentagonal prism base, rectangular prism base, triangular prism base, c-shaped prism base, triangular base, circular base, square base, octagonal base, heptagonal base, hexagonal base, pentagonal base, c-shaped base, or any other base that is able to engage a cord.

Any base described herein may be comprised of any material that is able to secure or engage a cord, and includes, but is not limited to, any metal, any metal alloy, aluminum, steel, plastic, rubber, or any combination thereof.

Any bar described in any embodiment herein is preferably elongated, and may also be straight, curved, or angular, having one or more obtuse angles or one or more substantially right angles. Any bar or bars may engage corresponding hinged receptacles at any angle, but bar or bars are preferably at a perpendicular, or substantially perpendicular angle to the hinged receptacles. In some embodiments, bars engage may engage the hinged receptacles at a non-perpendicular angle, and in these embodiments hinged receptacles change shape and size to accommodate the non-perpendicular angle. In other embodiments, the bar and the hinged receptacle, or the portion thereof that engages with the bar, rotate together to move the bar into an engaged or disengaged position. The proximal end of a bar may be fixed to a hinged receptacle by any means known in the art. In some embodiments described herein, a bar and a hinged receptacle may be an integral piece. Alternatively the proximal end of a bar may be tacked onto or slide into the hinged receptacle, and the two pieces may be sealed together by welding, epoxy, glue, screws or other mechanical means, magnets, or any other means known in the art.

Any bar described herein may be comprised of any material that is durable, and may be a semi-rigid or semi-flexible material, and materials include, but are not limited to, any metal, any metal alloy, aluminum, steel, plastic, rubber, or any combination thereof.

Any hinge or locking hinge described herein with respect to clamps, may be any type of hinge, including a ratcheting hinge, a hinge with a simple pin and pin release, a hinge that close based on friction between parts, or any other hinge typically used in clamps.

DETAILED DESCRIPTION OF THE DRAWINGS

Figure 1:
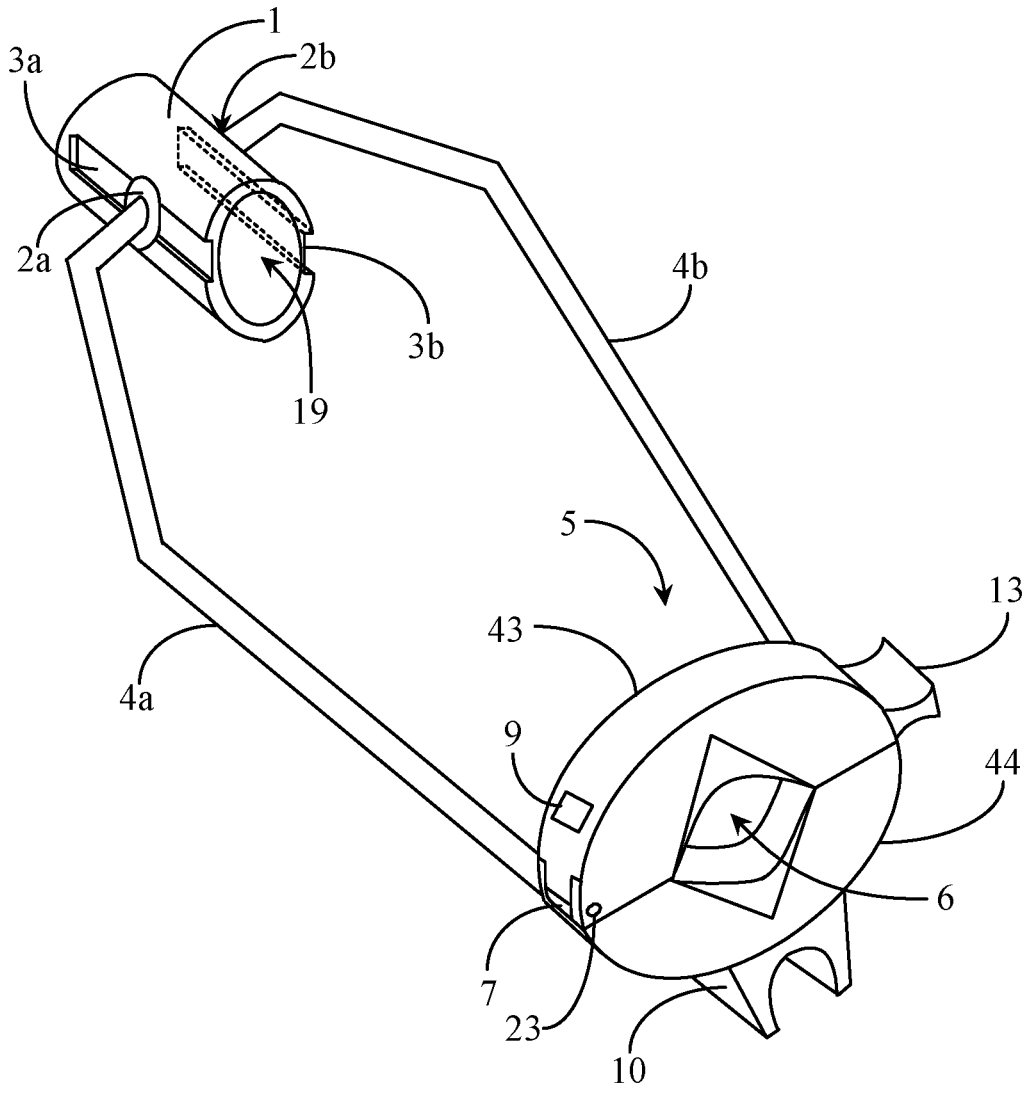
FIG. 1 is a basic version of a securement system in an unmodified form, stripped of any connectors to show components of the system.

FIG. 1 illustrates one embodiment of the securement system or device. FIG. 1 shows a first side of the device, which comprises tubular base 1. Tubular base 1 further comprises a hollow cylinder with first opening 19, hinge receptacle 2*a* and hinge receptacle 2*b* (not shown), and track 3*a* and track 3*b*. Hinge receptacles 2*a* and 2*b* (not shown) attach to tubular base 1 via tracks 3*a* and 3*b*, respectively. Hinge receptacles 2*a* and 2*b* (not shown) move slidably forward and backwards on tubular base 1 via tracks 3*a* and 3*b*, respectively. Tracks 3*a* and 3*b* can be rails attached to tubular base 1, grooves carved into base 1, recessed tracks, or any other similar means. A proximal end of bar 4*a* and a proximal end of bar 4*b* connect to tubular base 1 through hinge receptacles 2*a* and 2*b* (not shown), and a distal end of bar 4*a* and a distal end of bar 4*b* connect with clamp 5, defining the second side of the device. The second side of the device comprises clamp 5, having movable half 43 and fixed half 44. The distal end of bar 4*a* and the distal end of bar 4*b* are connected to movable half 43. Clamp 5 further comprises second opening 6, hinge 7, pin release 9, clip 10, and grip 13. Clamp 5 closes with hinge 7, which may be any type of hinge, including a ratcheting hinge or any other hinge typically used in clamps. Hinge 7 closes clamp 5 securely around different gauges of cords. Hinge 7 includes rod 23 and can be released by pin release 9. Grip 13 is permanently attached to movable half 43 and is located on the opposite side of clamp 5 as hinge 7. Grip 13 may help a user close clamp 5 with greater ease, simply grasp the device, or in any other way that is helpful to a user.

When in use, the device may connect any two conjoining connectors, and any cord attached to each connector. In one embodiment, the device may connect to a first plug, which may be a male conjoining plug or female conjoining plug, to a second plug, which may be a male or female conjoining plug. The first plug may be connected to a first power cord, and the second plug may be connected to a second power cord. The first power cord runs through first opening 19, and the second power cord runs through opening 6. Opening 6 may be comprised of any durable material, but is more preferably made of rubber or another material with grip that could adhere to the second power cord, thereby holding the second power cord in place. Clip 10 secures clamp 5 to the first power cord running through opening 19, such that the first power cord may be held in a fixed position. Clip 10 may also be used to hold either the first power cord, the second power cord, or any other cord at any time for the convenience of the user.

Hinge receptacles 2*a* and 2*b* (not shown) may optionally be able to slide forward and backwards on tubular base 1 via tracks 3*a* and 3*b*, respectively, so that clamp 5 can be adjusted to accommodate different sizes of connectors, and so that clamp 5 is directly behind a second plug. A benefit of clamp 5 landing directly behind the second plug is that it may provide an additional means to prevent accidental disconnection between a first plug and a second plug, or any two conjoining connectors.

Figure 2:
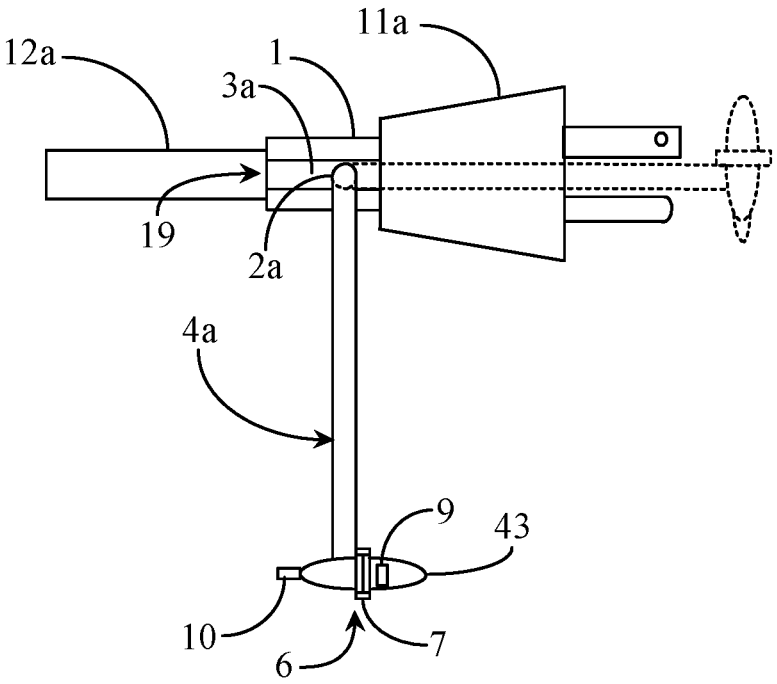
FIG. 2 shows a side view of the system with an electrical plug, illustrating how the bars move the clamp into an engaged position.

FIG. 2 illustrates a side view of an embodiment of the device in a disengaged position and an outline of bar 4*a*. Tubular base 1 is attached to first cord 12*a* running through first opening 19. First plug 11*a* may be permanently or removably affixed to power cord 12*a* and is directly adjacent to tubular base 1. In this illustration, first plug 11*a* is a male plug, and is not attached to a conjoining female plug. Hinge receptacle 2*a* and hinge receptacle 2*b* (not shown) connect with bars 4*a* and 4*b* (not shown), and enables bars 4*a* and 4*b* (not shown) to pivot clamp 5 (not shown) to an engaged or disengaged position. In this view, the device is disengaged, and bars 4*a* and 4*b* (not shown), are substantially perpendicular to tubular base 1, first plug 11*a*, and first cord 12*a*. Dotted outline of bars 4*a* and 4*b* (not shown) and the second side of the device show that bars 4*a* and 4*b* (not shown) pivot via hinge receptacles 2*a* and 2*b* (not shown), such that bars 4*a* and 4*b* (not shown) are substantially parallel to tubular base 1, first plug 11*a*, and first cord 12*a*. FIG. 2 further illustrates a dotted outline of bars 4*a* and 4*b* (not shown) and the second side of the device when in line with the first side of the device; in this position the second side of the device and clamp are in an engaged position, such that they can stabilize the connectors and prevent disconnection. The dotted outline illustrates that devices can be moved into an engaged position.

Figure 3:
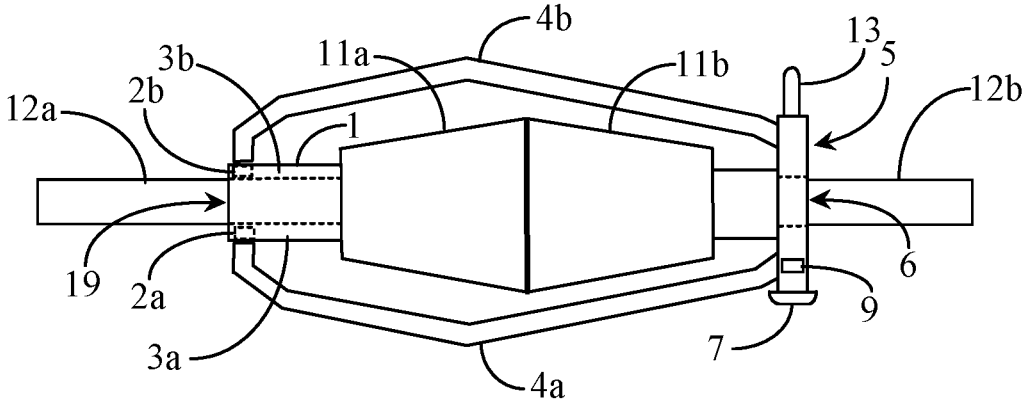
FIG. 3 shows a top view of the system securing two connectors to each other.

FIG. 3 shows a top down view of an embodiment of the device in an engaged position. Bars 4*a* and 4*b* are substantially parallel to tubular base 1, such that second opening 6 of clamp 5 is substantially aligned with first opening 19 of tubular base 1. First power cord 12*a* runs through first opening 19, and second power cord 12*b* runs through second opening 6. First plug 11*a* may be permanently, semi-permanently, or removably attached to first power cord 12*a*, and is detachably fixed to second plug 11*b*, which may be permanently, semi-permanently, or removably attached to second power cord 12*b*. First plug 11*a* may be a male plug or female plug, and second plug 11*b* is a conjoining plug that mates with either the male or female plug of 11*a*. Clamp 5 is butted up against second plug 11*b*, which provides additional stability and may further prevent accidental disconnection between 11*a* and 11*b*. Base 1 is butted up against first plug 11*a*, which also provides additional stability.

Figure 4A:
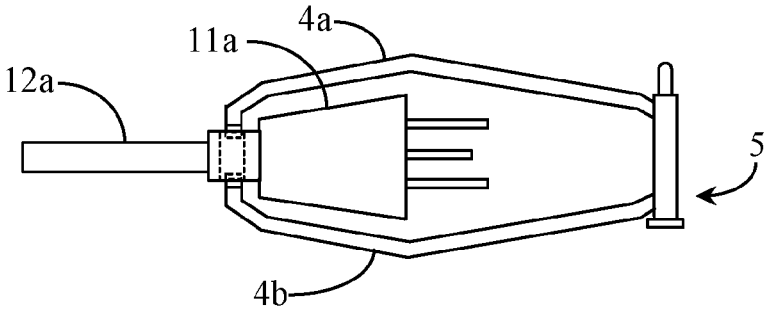
FIG. 4A a top view of the system with only one connector.

FIG. 4A is a top view of the device in an engaged position, with one only connector 11*a*. It shows clamp 5 when it is substantially in line with connector 11*a*.

Figure 4B:
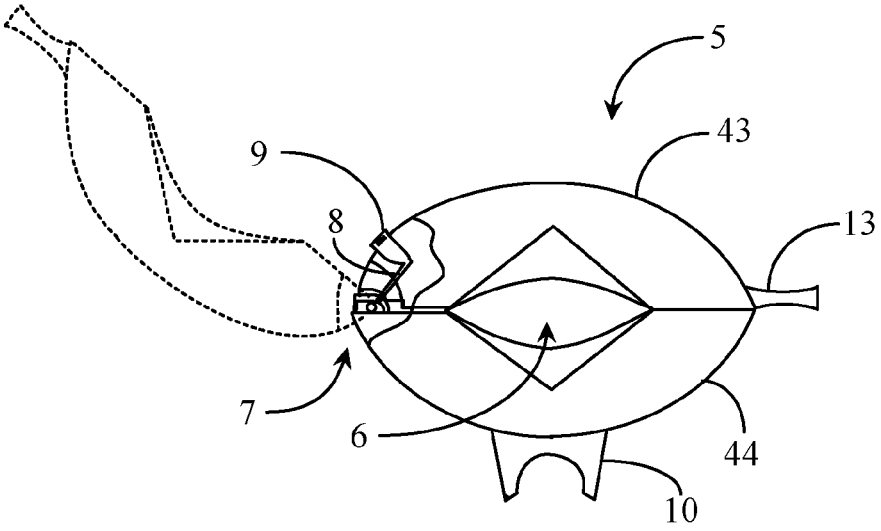
FIG. 4B shows a cross-section of the second side of the system, illustrating a clamp and parts thereof.

FIG. 4B shows a cross-section of one embodiment of clamp 5 revealing an internal mechanism for one embodiment of clamp 5. Here, clamp 5 comprises movable half 43 and fixed half 44. Grip 13 is attached to movable half 43, and serves as a grip for closing clamp 5, or otherwise adjusting the position of movable half 43. Dotted outline of movable half 43 shows clamp 5 in the open position. Clip 10 is attached to fixed half 44. Clip 10 may be used to hold the device in a disengaged position when clamp 5 is not in use, by engaging a first cord (not shown). Clip 10 may also be used to hold any cord for any reason. The portion of clamp 5 surrounding opening 6 may make contact with, and preferably grips, a second cord. Hinge 7 as illustrated here is a ratcheting hinge. Pin 8, and pin release 9 are also illustrated. When pin release 9 is depressed, hinge 7 is released, and clamp 5 may open and disengage the device, such that conjoining connectors can be disconnected and disengaged with the device. This embodiment is illustrated in more detail in FIG. 5.

Figure 5:
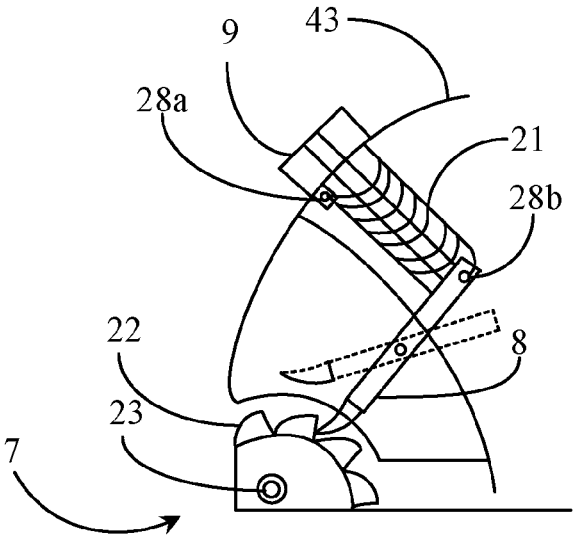
FIG. 5 is a close-up view of the clamp shown in FIG. 4B, illustrating an embodiment of a clamp's locking mechanism and a ratcheting hinge, and how the clamp and ratcheting hinge function together.

FIG. 5 is a close up view of clamp 5 as shown in FIG. 4B, further illustrating details of this embodiment of hinge 7. The hub of hinge 7 surrounds rod 23. Movable half 43 pivots from rod 23 to open or close clamp 5. Ratcheting teeth 22 interlock with pin 8. When pin 8 engages ratcheting teeth 22, movable half 43 can only move towards fixed half 44 (not shown), closing or tightening clamp 5. This is because pin 8 can only move over ratcheting teeth 22, not against them. Spring 21 is connected to pin 8 at anchor point 28*b*, and is connected to movable half 43 at 28*a*. Spring 21 provides tension that holds pin 8 in an engaged position with ratcheting teeth 22. Pin release 9 is linked to pin 8. When pin release 9 is depressed, clamp 5 opens. When depressed, pin release 9 pushes pin 8 and pin 8 disengages from ratcheting teeth 22, as shown by dotted outline of pin 8. When pin 8 is disengaged, movable half 43 can move away from fixed half 44 (not shown) allowing clamp 5 to open.

A user may open an embodiment of clamp 5 as shown in FIG. 4A and FIG. 5 by depressing pin release 9 and grasping grip 13 or movable half 43 to pull away fixed half 44. With the clamp open, the user could remove or add a cord and connecter to the device. A user may close this embodiment of clamp 5 by simply applying pressure to movable half 43 or grip 13, such that movable half 43 moves towards fixed half 44. Pin 8 would automatically catch or engage with ratcheting teeth 22.

Figure 6:
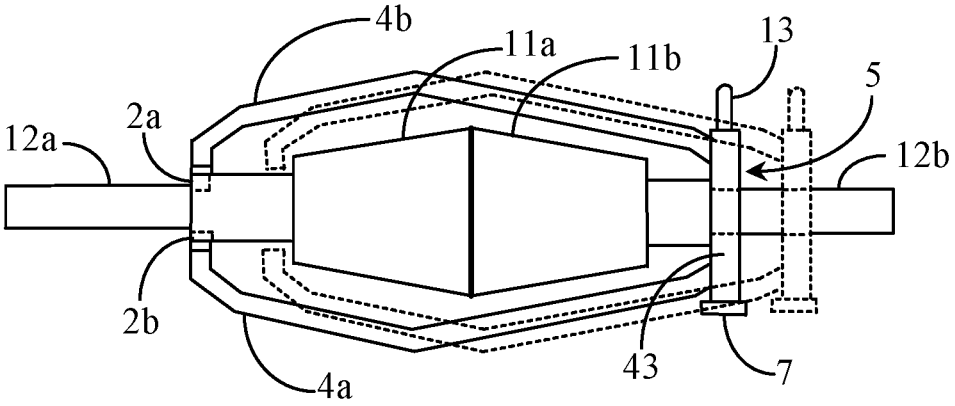
FIG. 6 shows how the bars may be adjusted to position the clamp such that it is directly adjacent to the second side of a connector, by moving the point at which bars are affixed to base of system.

FIG. 6 is a top view of the device shown in FIG. 3, with two connectors, first plug 11*a* and second plug 11*b*. Here, dotted outline of bars and second side illustrate that hinge receptacles 2*a* and 2*b* are able to slide back and forth along tubular base 1, thereby moving the second side of the device. The second side may be moved, such that clamp 5 lands directly adjacent to second plug 11*b*. The juxtaposition of clamp 5 and second plug 11*b* may ensure a more secure connection between first plug 11*a* and second plug 11*b*, thus further preventing unintentional disconnection between plugs 11*a* and 11*b*, or any two conjoining connectors. The dotted outline of bars and the second side show that clamp 5 may be pulled away from plug 11*b*.

Figure 7:
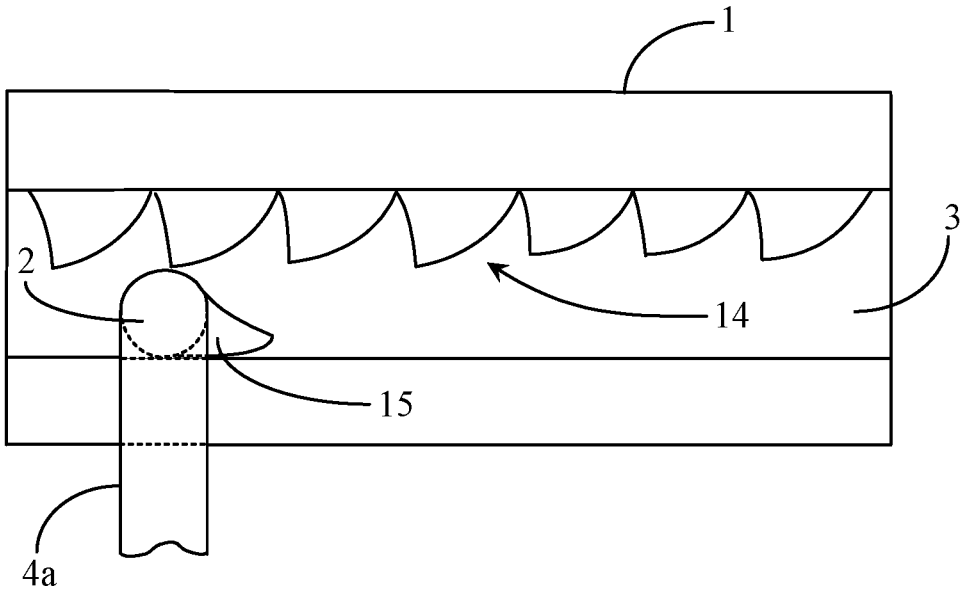
FIG. 7 shows an embodiment of a tubular base in a modified form with at least one bar in a disengaged position.

FIG. 7 shows a side view of an embodiment of tubular base 1. This embodiment shows that track 3 may be lined with grooved teeth 14. The proximal end of bar 4*a* rests in hinge receptacle 2, and rests against grooved teeth 14. Pawl 15 is fixed to the proximal end of bar 4*a*. Pawl 15 can be a pin, catch, tooth, or similar component. Bar 4*a* is perpendicular to tubular base 1. In this position, pawl 15 is disengaged from groove teeth 14, which allows bar 4*a* to slide back and forth along track 3. Bar 4*a* is not shown in its entirety because it is not necessary to show the second side of the device.

Figure 8:
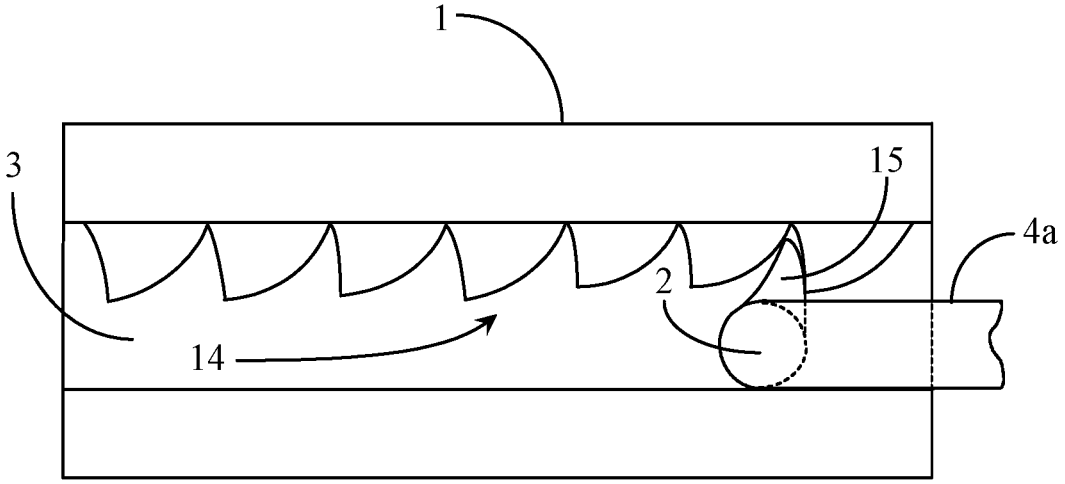
FIG. 8 shows the same version of the system illustrated in FIG. 7 with at least one bar in engaged or locked position.

FIG. 8 shows an embodiment of tubular base 1 as illustrated in FIG. 7 when bars 4*a* and 4*b* (not shown) have pivoted around hinge receptacle 2, such that bar 4*a* is in line with tubular base 1. When bar 4*a* is parallel to tubular base 1, pawl 15 pivots, such that it now engages groove teeth 14, and bar 4*a* is locked in the desired position. This locking mechanism may provide additional stability to the second side, and may further help to prevent disengagement of connectors.

Figure 9A:
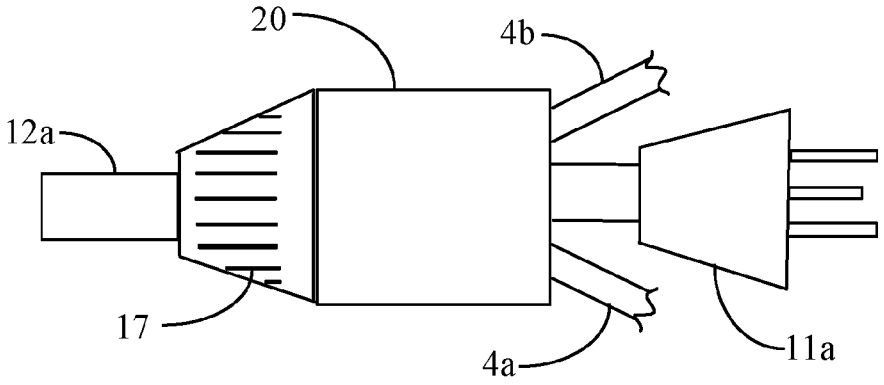
FIG. 9A shows another embodiment of the first side.

FIG. 9A is a top view of another embodiment of first side. This embodiment illustrates the first side comprising conical encasement 17 and tubular encasement 20. First power cord 12*a* runs through the center of conical encasement 17 and tubular encasement 20. Conical encasement 17 is attached to a screw top or twist top, such that when tightened a screw top or twist top may lock bars 4*a* and 4*b* into a particular position, preventing them from moving back and forth. Encasement 20 encloses moving parts of the locking mechanism as depicted in FIG. 10.

Figure 9B:
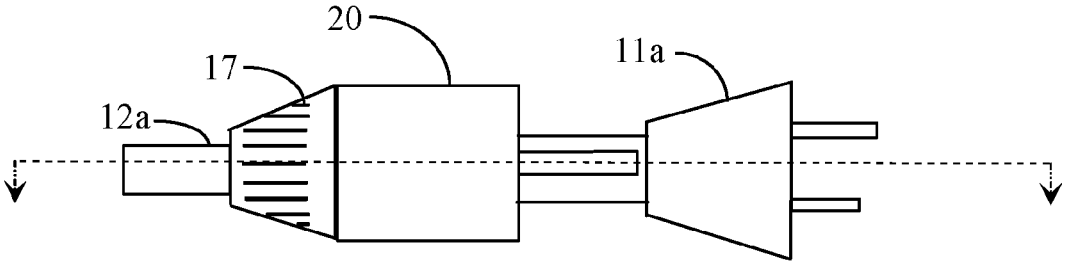
FIG. 9B shows the embodiment of FIG. 9A turned 90 degrees, and identifies where the cross-section of the first side shown in FIGS. 10, 11 and 12.

FIG. 9B is a side view of the devices of FIG. 9A turned 90 degrees. The dotted line illustrates the cross-sectional view shown in FIG. 10, FIG. 11, and FIG. 12.

Figure 10:
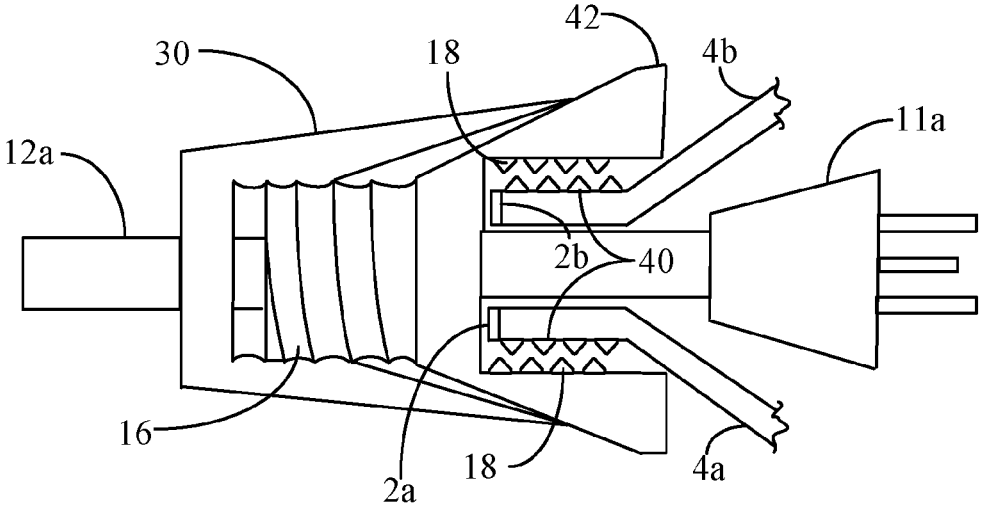
FIG. 10 shows a detailed cross-section of one embodiment of the first side illustrated in FIGS. 9A and 9B, further illustrating a screw base with multiple threads, and the bars in an unlocked position.

FIG. 10 is a cross-section showing how the depicted embodiment of the invention may function. First cord 12*a* runs through the first side, which comprises screw top 30, base screw 16, and flexible side body 42. Base screw 16 has multiple threads which engage threads at the proximal end of screw top 30. Screw top 30 engages base screw 16, such that when screw top 30 is turned, the distal end of screw top 30 applies inward pressure to flexible side body 42. Flexible side body 42 is comprised of a slightly flexible material, including but not limited to plastic, rubber, metal alloy, aluminum, tin, steel or any other suitable material. Exterior teeth 18 (not shown) are attached to flexible side body 42. Interior teeth 40 (not shown) are attached to bars 4*a* and 4*b* and are in close proximity to exterior teeth 18 (not shown). When the distal end of screw top 30 applies enough pressure to flexible side body 42, exterior teeth 18 (not shown) interlock with interior teeth 40 (not shown), such that bars 4*a* and 4*b* are fixed in position and will not slide forward or backwards.

When using an embodiment of FIGS. 9A and 9B, as further illustrated in FIG. 10, a user may slide bars 4*a* and 4*b* back and forth to adjust the location of the second side to determine a desired position. After determining a desired position, a user may lock bars 4*a* and 4*b* into position by grasping and twisting conical encasement 17, which is attached to and turns screw top 30 until screw top 30 applies enough pressure to flexible side body 42 to cause exterior teeth 18 to interlock with interior teeth 40.

Figure 11:
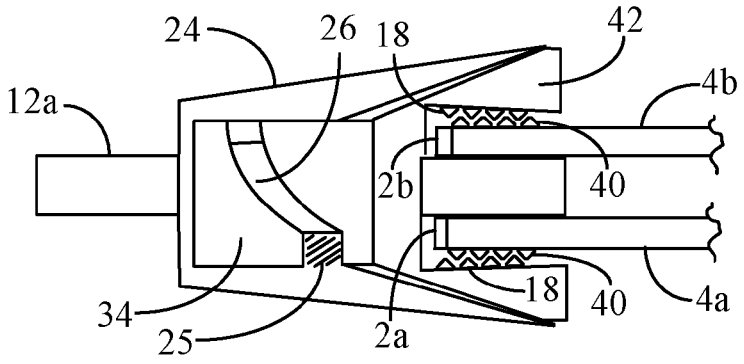
FIG. 11 is another embodiment of a twisting base illustrated in FIGS. 9A and 9B, illustrating a twist base having a single groove, and the bars in a locked position.

FIG. 11 is another embodiment of the first side in a locked position. Here, base screw 16 and screw top 30 of FIG. 10 are replaced with twisting base 34 having single groove 26, twisting top 24, and notch 25. Twisting top 24 moves notch 25 along groove 26. As notch 25 travels down groove 26, twisting top 24 moves downward, which causes the distal end of 24 to apply increasing pressure to flexible side body 42. Here, notch 25 is in a locked position, and the distal end of twisting top 24 applies enough pressure to flexible side body 42 to cause exterior teeth 18 to interlock with interior teeth 40. Thus, bars 4*a* and 4*b* are fixed in position and will not slide forward or backwards. This embodiment may allow bars 4*a* and 4*b* to become engaged and disengaged more efficiently than the embodiment shown in FIG. 10B, because doing so requires less motion to lock exterior teeth 18 with interior teeth 40.

Figure 12:
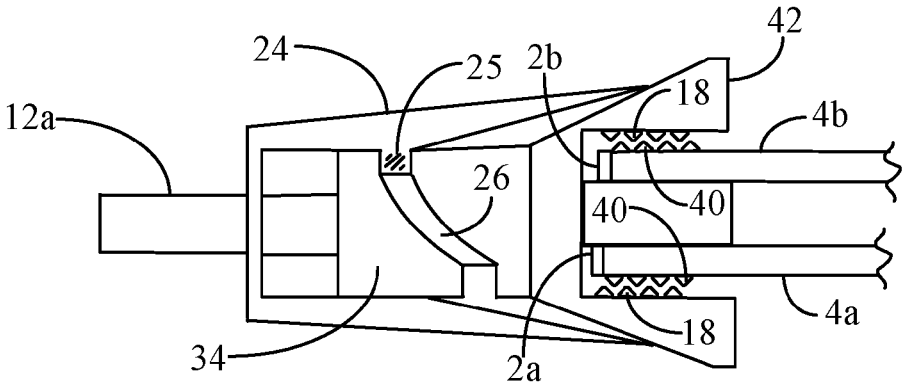
FIG. 12 illustrates the twisting base of FIG. 11 with the bars in an unlocked position.

FIG. 12 shows the device of FIG. 11 in an unlocked position. Notch 25 is at the top endpoint of groove 26. This position releases pressure on flexible side body 42 such that exterior teeth 18 are disengaged from interior teeth 40.

Figure 13:
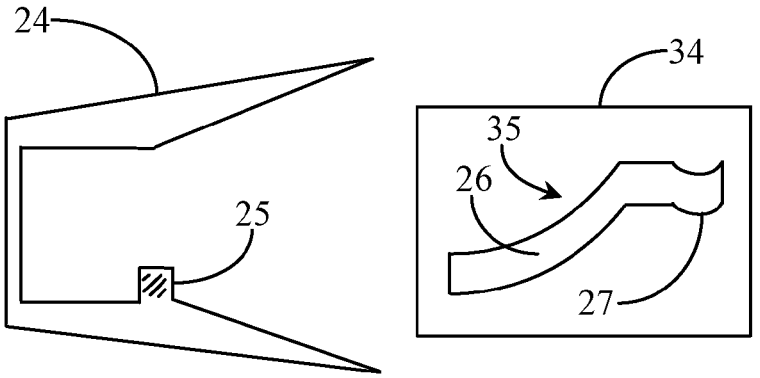
FIG. 13 shows male and female parts of the twisting base illustrated in FIG. 11 disassembled. The cylindrical male aspect is flattened to show full pattern of groove.

FIG. 13 shows a view of the twisting base 34 unrolled as groove pattern 35. Notch 25 of twisting top 24 is depicted, and interlocks with groove 26. Groove pattern 35 is an unrolled view of the full circumference of groove 26 illustrating an incline and divot 27. Catch 25 slides along groove 26, and in relation, moves twisting top 24 into, or out of, an engaged position. Divot 27 at the top of groove 26 holds notch 25 in an engaged position.

When using an embodiment of FIGS. 9A and 9B, as further illustrated in FIG. 11, FIG. 12 and FIG. 13, a user may slide bars 4*a* and 4*b* back and forth to adjust the location of the second side to determine a desired position. After determining a desired position, a user may lock bars 4*a* and 4*b* into position by grasping and twisting conical encasement 17, which is attached to and turns twisting top 24 until twisting top 24 applies enough pressure to flexible side body 42 to cause exterior teeth 18 to interlock with interior teeth 40. This typically occurs when notch 25 is in a locked position. In some embodiments, a user may engage or disengage with as little as an approximately 90 degree turn of conical encasement 17, as much as a 360 degree turn of conical encasement 17, and preferably a 180 turn of conical encasement 17.

Figure 14:
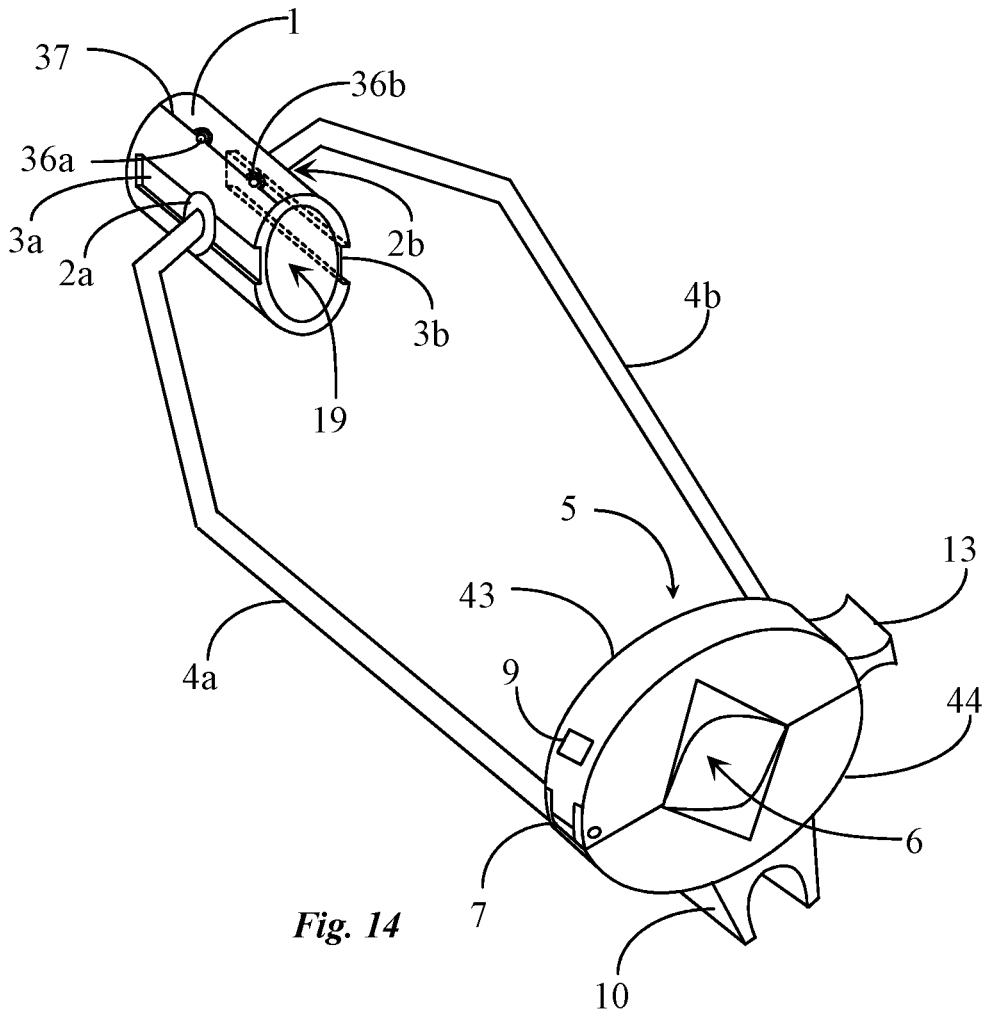
FIG. 14 is a modified embodiment of the system of FIG. 1 of invention, which may be used for aftermarket applications.

FIG. 14 shows another embodiment similar to the device shown in FIG. 1. In this embodiment, tubular base 1 further comprises split 37 and screws 36*a* and 36*b* that hold tubular base 1 together. Split 37 and screws 36*a* and 36*b* may also allow the device to be applied as an aftermarket application. While this embodiment shows two screws, other embodiments could have as few as one screw and as many as five screws to enable aftermarket application to a cord. Additionally, split 37 could also be secured in a closed position by one or more magnets, one or more loops, one or more clasps, one or more fasteners, or any other means known in the art.

Figure 15:
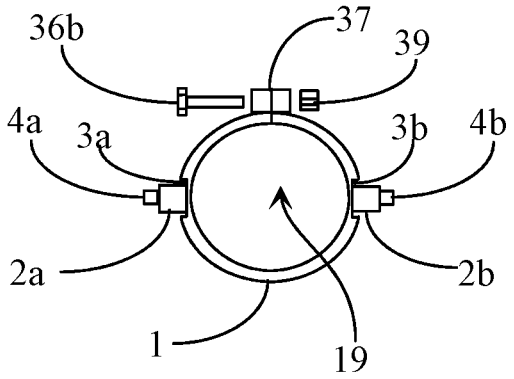
FIG. 15 shows a horizontal view of base in FIG. 14.

FIG. 15 is a front view of tubular base 1 similar to the one depicted in FIG. 14. In this case, only one screw holds split 37. Here, split 37 is on one side of tubular base 1, which further comprises a loop or other means to attach screw 36*b*. Screw 36*b* is held in place with nut 39, and holds split 37 together.

Figure 16:
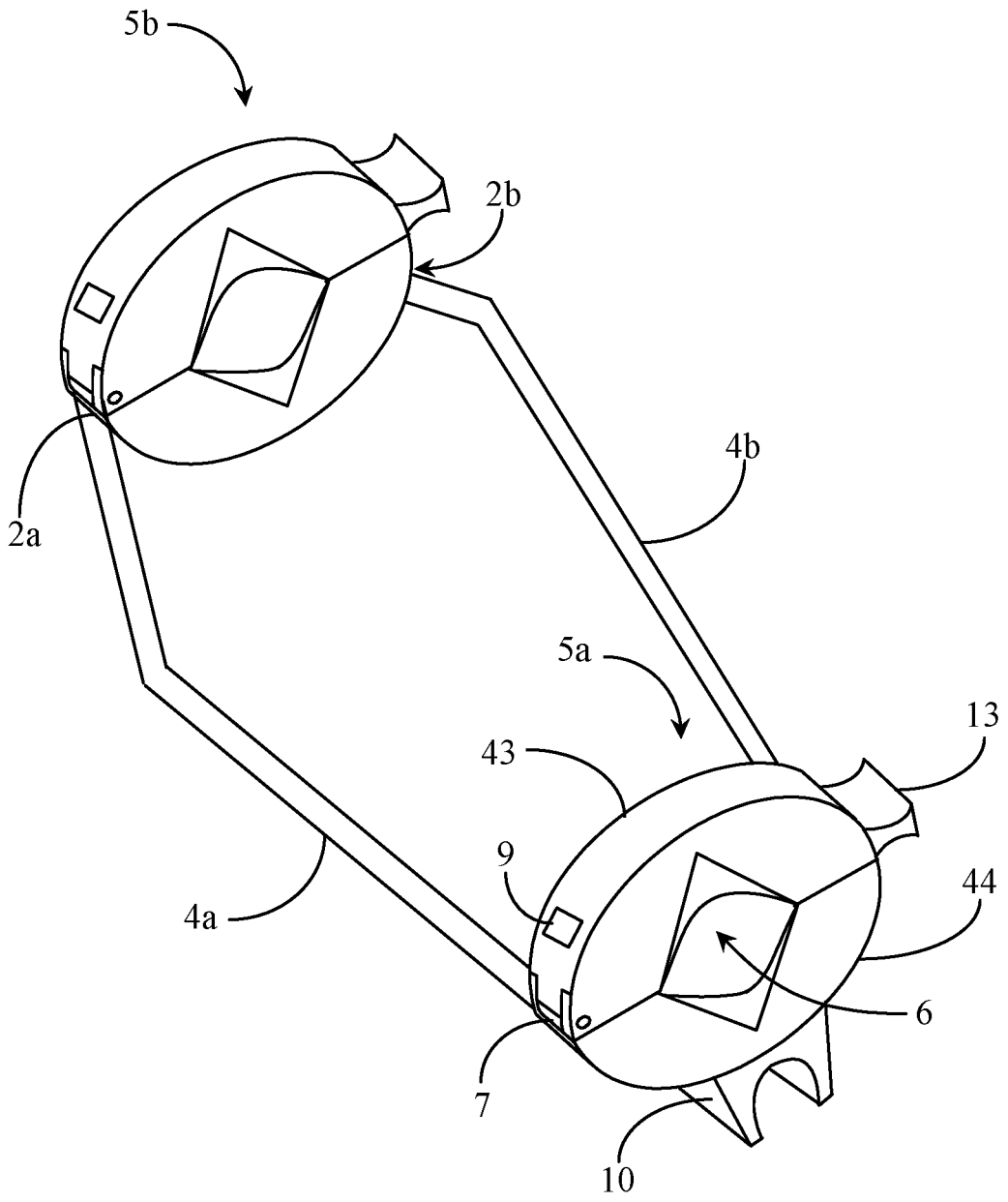
FIG. 16 is another embodiment of the system where the first end and the second end are both comprised of clamps, which may be for semi-permanent use.

FIG. 16 illustrates a semi-permanently applicable embodiment where the first side comprises clamp 5*a*, which further comprises second opening 6, hinge 7, pin release 9, clip 10, and grip 13. Clamp 5*a* also illustrates movable half 43 and fixed half 44. Clamp 5*b* may comprise the same components of clamp 5*a*, and further comprises hinge receptacles 2*a* and 2*b*. Clamp 5*b* is optionally a means to enable bars 4*a* and 4*b* to move in relation to clamp 5*a*, such that clamp 5*a* can be adjusted forwards and backwards, as to accommodate connectors of varying sizes. Any means of enabling bars 4*a* and 4*b* to move back and forth in relation to the second side as described herein are also applicable to this embodiment.

The invention claimed is:

1. A device for securing engaged connectors, comprising;

a first side including a retention mechanism comprising a fixed half and a movable half, the two halves connected at one edge, via a locking hinge, forming a clamp with a second opening engaging a second cord attached to a second connector;

a second side including a second retention mechanism having similar components as the first side, comprising a second fixed half and a second movable half, the two halves connected at one edge, via a second locking hinge, forming a second clamp with a second opening engaging a second cord attached to a second connector;

two elongated bars, one each attached at one end to opposing sides of the fixed half, the elongated bars each having a distal portion and a distal end extending away from the first half base past the first connector, one each of the distal ends attached at opposing sides of the second fixed half, each elongated bar including an obtuse angle at a same position on each distal portion of the elongated bars, thereby creating a greater distance between the distal portions of the two elongated bars than a first distance between the distal ends attached to the fixed half and a second distance between the hinged receptacles;

wherein the first and second connectors are oriented within the elongated bars enabling engagement of the connectors and the first and second retention mechanism prohibits separation of the connectors, when closed and locked; and wherein a row of ratchet teeth are arranged in at least one of the tracks and a corresponding pawl at proximal end of each elongated bar in place of the hinge receptacle, wherein when the elongated bars are oriented in a linear fashion extending past the first connector, the pawl engages between two of the ratchet teeth, thereby prohibiting movement of the proximal end of the elongated bars along the track, and when the elongated bars are oriented perpendicular and below the tubular base, the pawl disengages from between the teeth enabling translation along the track.

2. The device of claim 1, wherein the locking hinge locks when the movable half is closed upon the fixed half and the movable half includes a pin release connected to the locking hinge enabling release of the locking hinge when opening of the clamp is desired.

3. The device of claim 1, wherein the second locking hinge locks when the second movable half is closed upon the second fixed half and the second movable half includes a second pin release connected to the second locking hinge enabling release of the second locking hinge when opening of the second clamp is desired.

4. A device for securing engaged connectors, comprising:

a first side comprising a tubular base with a first opening engaging a first cord attached to a first connector and including two tracks positioned at opposing outer sides of the tubular base;

a second side including a retention mechanism comprising a fixed half including a movable half, the two halves connected at one edge, via a locking hinge, forming a clamp with a second opening engaging a second cord attached to a second connector;

two elongated bars, one each movably attached at a proximal end to a hinged receptacle in one of the tracks, the elongated bars each having a distal portion and a distal end extending away from the tubular base past the first connector, one each of the distal ends fixably attached at opposing sides of the fixed half;

wherein the first and second connectors are oriented within the elongated bars enabling engagement of the connectors, and the retention mechanism prohibits separation of the connectors, once closed and locked; and wherein a row of ratchet teeth are arranged in at least one of the tracks and a corresponding pawl at proximal end of each elongated bar in place of the hinge receptacle, wherein when the elongated bars are oriented in a linear fashion extending past the first connector, the pawl engages between two of the ratchet teeth, thereby prohibiting movement of the proximal end of the elongated bars along the track, and when the elongated bars are oriented perpendicular and below the tubular base, the pawl disengages from between the teeth enabling translation along the track.

5. The device of claim 4, wherein the locking hinge locks when the movable half is closed upon the fixed half and the movable half includes a pin release connected to the locking hinge enabling release of the locking hinge when opening of the clamp is desired.

6. The device of claim 4, wherein the tubular base is removed or attached to the cord by a split running along a top side of the tubular base, the split including a first edge having a first tap or threaded hole, and a second edge having a second tap or threaded hole, the first and second holes oriented on the first and second edge creating a throughway for inserting a fastening screw or other fastener.

7. The device of claim 4, wherein the hinge receptacles translate along the tracks and the proximal ends of the elongated bars freely rotate in the hinge receptacles.

8. The device of claim 7, wherein the proximal ends of the elongated bars attach to the hinged receptacles at a perpendicular angle and the distal portions of the elongated bars include at least two obtuse angles at a same position on each distal portion of the elongated bars, thereby creating a greater distance between the distal portions of the two elongated bars than a first distance between the distal ends attached to the fixed half and a second distance between the hinge receptacles.

9. The device of claim 8, wherein the elongated bars attached at the base translate back and forth in the tracks when the clamp is in an open position enabling flexibility of movement between the connectors when engaging the first and second connectors.

10. A method for securing two engaged connector ends of power cords, comprising the steps of:

a) engaging a first power cord attached to a first male or female connector through a tubular base including two tracks positioned at opposing outer sides of the tubular base;

b) engaging a second power cord attached to a second male or female connector through an opening formed in a clamp comprising a fixed half and a movable half, the two halves connected at one edge, via a locking hinge;

c) connecting the tubular base and the clamp via two elongated bars, each elongated bar having a proximal end connected, one each to a hinged receptacle in one of the tracks, and a distal end fixably attached to one of the opposing sides of the fixed half and each elongated bar having a distal portion between the proximal end and the distal end; and d) orienting the first and second connectors enabling engagement with each other, once engaged with the movable half closed the locking hinge lock engages preventing separation of the first and second connectors;

wherein a row of ratchet teeth are arranged in at least one of the tracks and a corresponding pawl at distal end of each bar in place of the hinged receptacle, wherein when the bars are oriented in a linear fashion extending past the first connector, the pawl engages between two of the ratchet teeth thereby prohibiting movement of the distal bar ends along the track, and when the elongated bars are oriented perpendicular and below the tubular base, the pawl disengages from between the teeth enabling translation along the track.

11. The method of claim 10, wherein the tubular base is removed or attached to the cord by a split running along a top side of the tubular base, the split including a first edge having a first tap or threaded hole, and a second edge having a second tap or threaded hole, the first and second holes oriented on the first and second edge creating a throughway for inserting a fastening screw or other fastener.

12. The method of claim 10, wherein the hinge receptacles freely translate along the tracks and the distal ends of the elongated bars freely rotate in the hinge receptacles.

13. The method of claim 12, wherein the proximal ends of the bars attach to the hinge receptacles at a perpendicular angle and the distal portions of the elongated bars include at least two obtuse angles at a same position on each distal portion of the elongated bars thereby creating a greater distance between the distal portions of the two elongated bars than a first distance between the distal ends attached to the fixed half and a second distance between the hinge receptacles.

14. The method of claim 12, wherein the elongated bars attached at the tubular base translate back and forth in the tracks when the clamp is in an open position enabling flexibility when engaging the first and second connectors.

15. The method of claim 14, wherein the locking hinge locks when the movable half is closed upon the fixed half and the movable half includes a pin release when opening of the clamp is desired.

* * * * *